US010941634B2

(12) United States Patent
Vick, Jr.

(10) Patent No.: US 10,941,634 B2
(45) Date of Patent: Mar. 9, 2021

(54) CONTROL LINE PRESSURE CONTROLLED SAFETY VALVE EQUALIZATION

(71) Applicant: Halliburton Energy Services, Inc., Houston, TX (US)

(72) Inventor: James Dan Vick, Jr., Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/605,411

(22) PCT Filed: Jul. 18, 2017

(86) PCT No.: PCT/US2017/042648

§ 371 (c)(1),
(2) Date: Oct. 15, 2019

(87) PCT Pub. No.: WO2019/017921

PCT Pub. Date: Jan. 24, 2019

(65) Prior Publication Data

US 2020/0048988 A1 Feb. 13, 2020

(51) Int. Cl.
*E21B 34/10* (2006.01)
*E21B 43/12* (2006.01)

(52) U.S. Cl.
CPC ..... *E21B 34/101* (2013.01); *E21B 43/12* (2013.01); *E21B 34/102* (2013.01); *E21B 34/105* (2013.01); *E21B 2200/04* (2020.05); *E21B 2200/05* (2020.05)

(58) Field of Classification Search
CPC .... E21B 34/101; E21B 34/102; E21B 34/105; E21B 43/12; E21B 2200/04; E21B 2200/05
USPC ..... 166/324
See application file for complete search history.

(56) References Cited

U.S. PATENT DOCUMENTS 4,621,695 A 11/1986 Pringle
4,722,399 A 2/1988 Pringle
5,058,682 A * 10/1991 Pringle ..... E21B 34/101 166/324
5,503,229 A 4/1996 Hill, Jr. et al.
5,752,569 A 5/1998 Bhavsar et al.
6,079,497 A 6/2000 Johnston et al.
(Continued)

FOREIGN PATENT DOCUMENTS

WO 2012141753 A1 10/2012

OTHER PUBLICATIONS

International Search Report and Written Opinion dated Dec. 21, 2017; International PCT Application No. PCT/US2017/042648.

*Primary Examiner* — Matthew R Buck
*Assistant Examiner* — Patrick F Lambe
(74) *Attorney, Agent, or Firm* — McGuireWoods LLP

(57) ABSTRACT

A system for controlling fluid flow in a subterranean well includes a first valve, a control line fluidly coupled to the first valve, an equalizing line disposed externally to and separate from the first valve, and at least a second valve disposed in the equalizing line and in fluid communication with the control line. The first valve includes a body defining a lumen, and an upper portion, and a lower portion. The equalizing line is in fluid communication with the lumen between the upper portion and the lower portion of the body. The second valve equalizes a pressure between the upper and lower portions of the body.

20 Claims, 5 Drawing Sheets

(56) References Cited

U.S. PATENT DOCUMENTS

| | | | | |
|---|---|---|---|---|
| 6,296,061 | B1 | 10/2001 | Leismer | |
| 7,537,056 | B2 | 5/2009 | MacDougall | |
| 10,113,392 | B2 * | 10/2018 | Vick, Jr. | E21B 34/14 |
| 2008/0066921 | A1 * | 3/2008 | Bane | E21B 34/10 166/316 |
| 2008/0128137 | A1 * | 6/2008 | Anderson | E21B 34/101 166/319 |
| 2009/0188662 | A1 * | 7/2009 | Casciaro | E21B 34/12 166/53 |

* cited by examiner

CONTROL LINE PRESSURE CONTROLLED SAFETY VALVE EQUALIZATION

TECHNICAL FIELD

The present disclosure generally relates to subterranean wellbore operations and equipment and, more specifically, to a pressure-equalizing device for a subsurface safety valve (SSSV).

BACKGROUND OF THE DISCLOSURE

Subsurface safety valves (SSSVs) are well known in the oil and gas industry and provide one of many failsafe mechanisms to prevent the uncontrolled release of wellbore fluids should a wellbore system experience a loss in containment. Typically, subsurface safety valves comprise a portion of a tubing string set in place during completion of a wellbore. Although a number of design variations are possible for subsurface safety valves, the vast majority are flapper-type valves that open and close in response to longitudinal movement of a flow tube. Since subsurface safety valves provide a failsafe mechanism, the default positioning of the flapper is usually closed in order to minimize the potential for inadvertent release of wellbore fluids. The flapper can be opened through various means of control from the earth's surface in order to provide a flow pathway for production to occur.

In many instances, the flow tube can be regulated from the earth's surface using a piston and rod assembly that may be hydraulically charged via a control line linked to a hydraulic manifold or control panel. The term "control line" will be used herein to refer to a hydraulic line configured to displace the flow tube of a subsurface safety valve downward upon pressurization, or otherwise to become further removed from the exit of a wellbore. When sufficient hydraulic pressure is conveyed to a subsurface safety valve via the control line, the piston and rod assembly forces the flow tube downward (compressing the power spring), which causes the flapper to move into its open position upon overcoming forces that tend to keep the flapper closed (e.g., biasing springs, downhole pressure, and the like). When the hydraulic pressure is removed from the control line, the power spring shift the flow tube upward and the flapper returns to its default, closed position. A self-closing mechanism, such as a torsion spring, can also be present to promote closure of the flapper should a loss of hydraulic pressure occur.

Most safety valve failures are due to leakage past a closure device of the valve, such as a flapper or ball closure, of the safety valve. One of the main causes of closure device leakage is damage due to slam closure (i.e., an extremely fast closing of the closure device due, for example, to closing the valve during high velocity gas flow through the valve, etc.). Slam closures can also cause damage to a flow tube or opening prong of the safety valve, and to a pivot for the closure device. Another cause of closure device leakage is erosion due to high velocity flow past sealing surfaces on the closure device and its seat.

The description provided in the background section should not be assumed to be prior art merely because it is mentioned in or associated with the background section. The background section may include information that describes one or more aspects of the subject technology

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

Figure 1:
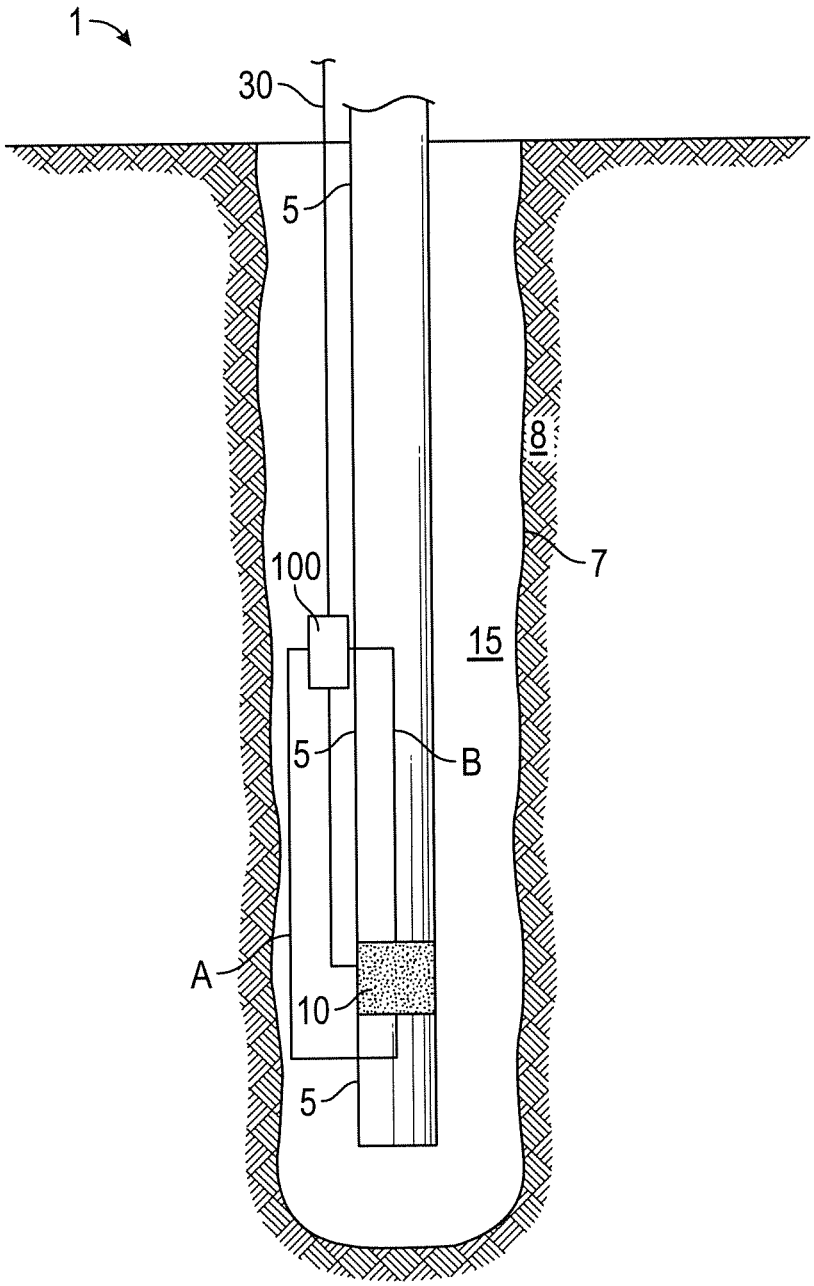
FIG. 1 illustrates a schematic diagram of a wellbore system containing a tubing string and a safety valve attached thereto.

In one or more implementations, not all of the depicted components in each figure may be required, and one or more implementations may include additional components not shown in a figure. Variations in the arrangement and type of the components may be made without departing from the scope of the subject disclosure. Additional components, different components, or fewer components may be utilized within the scope of the subject disclosure.

DETAILED DESCRIPTION

The detailed description set forth below is intended as a description of various implementations and is not intended to represent the only implementations in which the subject technology may be practiced. As those skilled in the art would realize, the described implementations may be modified in various different ways, all without departing from the scope of the present disclosure. Accordingly, the drawings and description are to be regarded as illustrative in nature and not restrictive.

The present disclosure generally relates to subterranean wellbore operations and equipment and, more specifically, to a pressure equalization valve.

Equalization valves are typically actuated by a flow tube pushing against, and causing a closure mechanism of the safety valve, e.g., a flapper that opens and closes in response to longitudinal movement of the flow tube. In some aspects, the equalization takes place through a seat of the safety valve, or through the closure mechanism of the safety valve being displaced off the seat by the longitudinal movement of the flow tube. The aforementioned configuration however provides certain limitations in terms efficiently and successfully performing equalization, which will be described in more detail below.

In some aspects, closure mechanism of the safety valve is biased by a spring to a normally closed position and maintained in an open position by pressurized hydraulic fluid flowing therethrough from a control line. When appropriately connected to a port of the control line, the hydraulic control line establishes fluid communication with a piston bore defined in a housing of the safety valve, thereby allowing hydraulic fluid pressure to be conveyed thereto. A piston assembly arranged within the piston bore may include a piston rod that extends axially therethrough to cause axial motion of a flow tube in the direction of the applied force to displace the closure mechanism of the safety valve to an open position.

Some aspects include the realization that when the closure mechanism of the safety valve is in the closed position, well fluid pressure below the closure mechanism acting upon a relatively large surface area of the closure mechanism makes opening of the closure mechanism difficult. This difficulty in opening the valve closure mechanism cannot be easily overcome simply by increasing the force applied to the closure mechanism using the piston assembly because the cross-sectional area of the piston assembly is limited by the relatively small size of the bore within which it is accommodated. Thus, a high fluid pressure would be required to overcome the well fluid pressure acting on the relatively large surface area of the valve closure mechanism below the valve closure mechanism. This high fluid pressure may in turn burst the control line carrying the hydraulic fluid from the earth's surface to the piston assembly.

The aforementioned problems have been addressed by conventional equalization methods, which utilize an equalization device positioned within the closure mechanism of the safety valve in order to equalize the pressure above and below the safety valve closure mechanism. However, the aforementioned configuration limits the size of the equalization valve to the relatively small cross-sectional width of the closure mechanism of the safety valve, thus equalization may take a prolonged period of time, e.g., several hours to occur in a gas well.

Additionally, some aspects include the realization that because the pressure of the hydraulic fluid in the control line must overcome the well pressure above the valve closure mechanism, the spring biasing the closure mechanism of the safety valve to the closed position, and a closure mechanism of the equalization valve (e.g., poppet) held on seat in the closed position by the pressure below the safety valve closure mechanism (e.g., flapper), there is a limit to the pressure differential above and below the flapper for which can be equalized. In addition, the rigidity of a lower nose portion of the flow tube is susceptible to being compromised.

Furthermore, some aspects include the realization that due to the length of the equalization period, the relatively small equalization seat is prone to damage and erosion due to debris carried by the high velocity fluid stream.

Some aspects also include the realization that conventional valve equalization devices can experience damage to the closure mechanism (e.g., poppet) of the valve equalization device due to "slam" closure thereof (i.e., an extremely fast closing of the closure mechanism due, for example, to closing the equalization valve during high velocity gas flow through the valve, etc.). Slam closures can also cause damage to the flow tube or of the safety valve.

Accordingly, the present disclosure describes an equalization valve for use in conjunction with a subsurface safety valve (SSSV), some aspects of which are capable of providing an increased equalization cross-section, configured so that the closure mechanism (e.g., poppet) closes before the closure mechanism of the safety valve, thus eliminating slam closure, and additionally configured to minimize debris carried in the carried by the high velocity fluid stream.

Various aspects of the present disclosure are directed to a system for controlling fluid flow in a subterranean well, including a first valve and a second valve. The second valve is in fluid communication with an equalizing line, which is in fluid communication with a lumen of the first valve, and is configured to equalize fluid pressure above and below a valve closure mechanism of the first valve.

To this effect, the first valve may be a safety valve 10, and the second valve may be an equalization valve 100, as described in further detail below.

FIG. 1 shows an illustrative schematic of a wellbore system 1 containing a tubing string 14 having a tubing-retrievable safety valve 10 attached thereto. It is to be recognized that safety valve 10 (as detailed in FIGS. 2, 4 and 5) is merely illustrative of many possible configuration for a hydraulically operated safety valve. Hence, other safety valves may operate using similar principles, and the depicted valve configuration should not be considered limiting. The tubing-retrievable safety valve 10 may represent a primary safety valve of the wellbore system. The terms "tubing-retrievable safety valve," "primary safety valve," and "safety valve" are synonymous and may be used interchangeably herein. In wellbore system 1, wellbore 7 penetrates subterranean formation 8. Although wellbore 7 is depicted as being substantially vertical in FIG. 1, it is to be recognized that one or more non-vertical sections may also be present and are fully consistent with the aspects of the present disclosure. Tubing string 5 is disposed within at least a portion of the length of wellbore 7, with annulus 15 being defined between the exterior of tubing string 5 and the interior of wellbore 7. Tubing string 5 further defines an internal flow pathway therethrough (not shown in FIG. 1). Safety valve 10 is interconnected to tubing string 5 and is configured to regulate fluid flow above and below safety valve 10 within the internal flow pathway, including shutting off fluid access in the event of an emergency.

Figure 2:
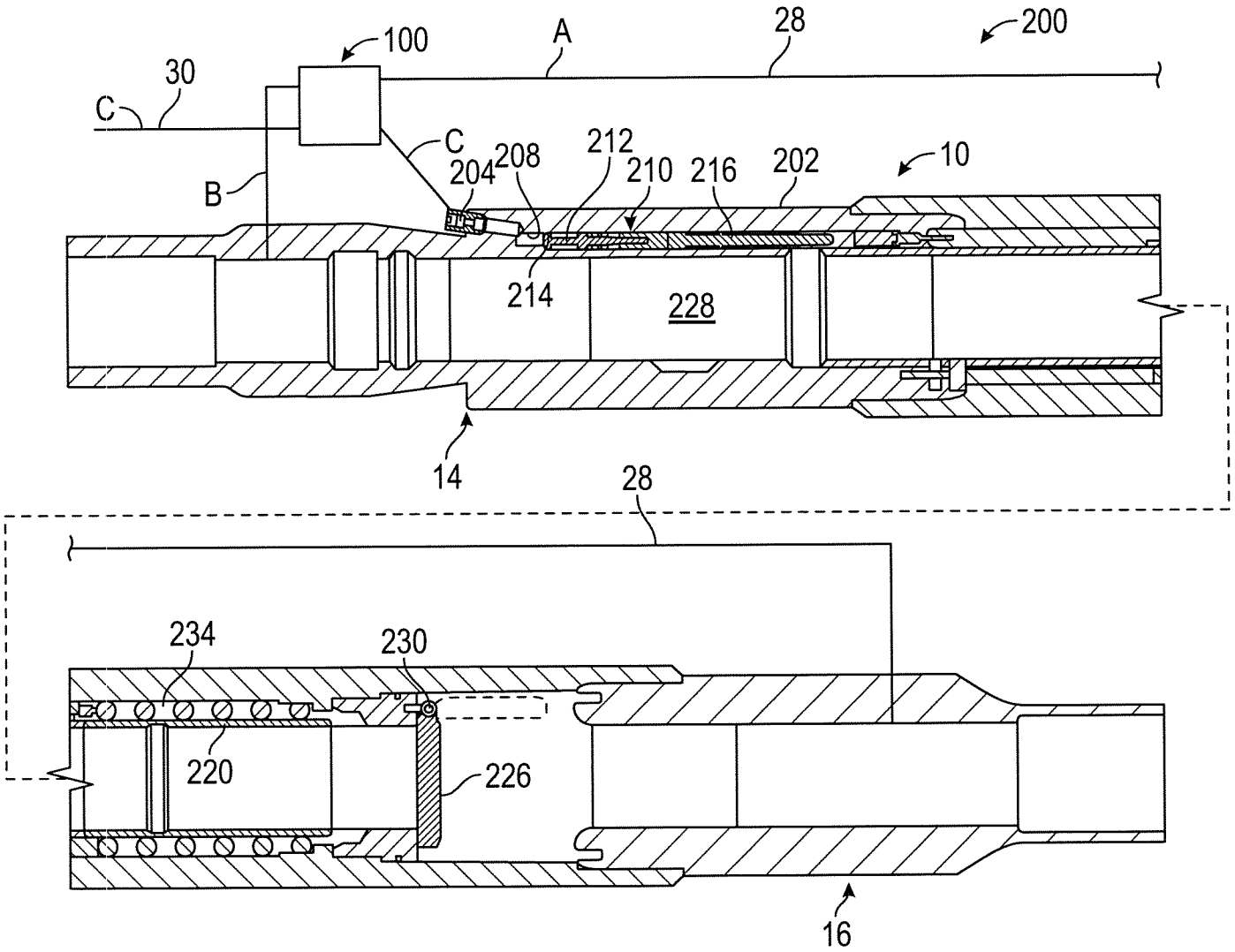
FIG. 2 illustrates a detailed schematic of an exemplary system for controlling fluid flow in a subterranean well.

In accordance with some aspects of the present disclosure, a system 200 for controlling fluid flow in a subterranean well (wellbore 7) includes a safety valve 10, a control line 30, an equalizing line 28, and an equalization valve 100 in fluid communication with the equalizing line 28. The safety valve 10 includes a body 202 defining a lumen 228 extending through the body 202. The body 202 includes an upper portion 14 and a lower portion 16. In some aspects of the present disclosure, the body 202 is coupled to tubing string 5 at opposing ends of housing 202. The safety valve 10 further includes a valve closure mechanism 226 (e.g., a flapper) disposed in the body 202 and moveable between an open position and a closed position to selectively allow and prevent fluid from flowing through the body 202. Flapper 226 is shown in FIG. 2 in its default, closed position such that fluid flow into lumen 228 from downhole (i.e., to the right of FIG. 2) is substantially blocked. In some aspects, at least one torsion spring 230 biases safety valve closure mechanism (i.e., flapper) 226 to the closed position. In some aspects, the safety valve 10 further includes a flow tube 220 reciprocably disposed in the body 202 to contact and displace the safety valve closure mechanism 226 from the closed to the open position.

According to some aspects of the disclosure, the control line 30 is fluidly coupled to the safety valve 10 to control actuation of the valve 10. Control line 30 may extend from the earth's surface in order to allow operation of safety valve 10 to take place from a rig, wellhead installation, or subsea platform located on the earth's surface or the ocean's surface. As illustrated in FIG. 1, control line 30 extends to safety valve 10 within well annulus 15, in close proximity to tubing string 5. However, other configurations for control line 30 are also possible. In alternative configurations, for instance, control line 30 may be located in the internal flow pathway of tubing string 5 or be defined, at least in part, in a sidewall of tubing string 5 or a component thereof. Regardless of its particular configuration, control line 20 allows safety valve 10 to be controlled hydraulically from the earth's surface.

FIG. 2 shows a detailed schematic of an exemplary system for controlling fluid flow in a subterranean well in accordance with some aspects. With continued reference to FIG. 1, FIG. 2 shows progressive cross-sectional side views of illustrative safety valve 10 and its hydraulic operating mechanisms. A control line port 204 may be provided in the body 202 for connecting the hydraulic control line 30 to the safety valve 10. When appropriately connected to control line port 204, the hydraulic control line establishes fluid communication with a piston bore 208 defined in housing 202, thereby allowing hydraulic fluid pressure to be conveyed thereto. Piston bore 208 may be an elongate channel or conduit that extends substantially longitudinally along a portion of the axial length of safety valve 10.

In accordance with some aspects of the disclosure, the safety valve 10 further includes a piston assembly 210 arranged within piston bore 208 in the body 202 of the safety valve 10 and configured to translate axially therein. Piston assembly 210 also includes piston rod 216 that extends longitudinally from piston assembly 210 through at least a portion of piston bore 208. At a distal end of piston rod 216, it may be coupled to an actuator sleeve which causes motion of the flow tube 220 axially in the direction of the applied force (i.e., downward with increasing hydraulic pressure).

The safety valve 10 further includes an elastic body 234 disposed in the lower portion 16 of the body 202 and configured to apply an opposing force to the hydraulic fluid in the control line 30 to keep the safety valve closure mechanism 236 in the closed position and help to prevent the safety valve closure mechanism 226 from being opened inadvertently. In some aspects, the elastic body 234 may be a power spring 234, but is not limited thereto. For example, the elastic body 234 may be any mechanism or structure capable of expanding and compressing in response to a force applied or removed thereto. Accordingly, expansion of the spring 234 causes the piston assembly 210 to move upwardly within piston bore 208. It should be noted that in addition to spring 234, other types of biasing devices, such as a compressed gas with appropriate sealing mechanisms, may be employed similarly.

Figure 3:
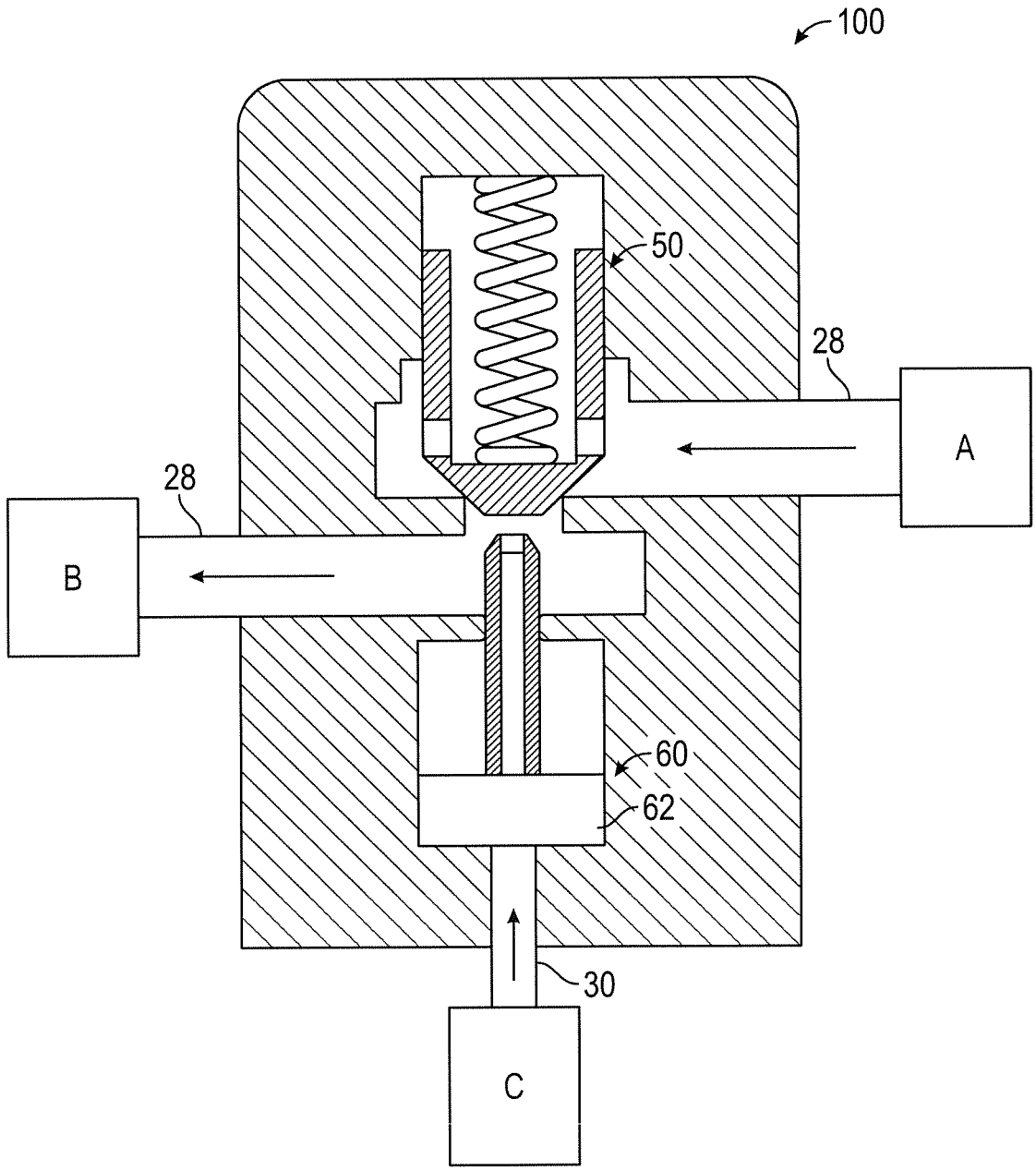
FIG. 3 illustrates a schematic diagram of an exemplary equalization valve.

FIG. 3 illustrates a schematic diagram of an exemplary equalization valve 100. As described above, with respect to FIG. 2, system 200 includes the equalizing line 28 (illustrated in FIG. 2) disposed exterior to the safety valve 10 and in fluid communication with the lumen 228 between the upper portion 14 and the lower portion 16 of the body 202. The equalization valve 100 is in fluid communication with the control line 30 to equalize a pressure between the upper 14 and lower 16 portions of the body 202. As illustrated in FIG. 3, the equalization valve 100 includes an equalization valve closure mechanism 50 (e.g., a poppet) which is mounted within a bore of the equalization valve 100. The bore of the equalization valve 100 in which the poppet 50 is mounted, is fluidly coupled to the lumen 228 in the lower portion of the safety valve 10 through section A of the equalizing line 28. Thus, the poppet is fluidly coupled to the lumen 228 of the safety valve 10 at a position below the safety valve closure mechanism 226. In some aspects, as illustrated in FIG. 3, the equalization valve closure mechanism 50 is illustrated as a poppet 50, which is spring loaded through an elastic body, e.g., a spring. However, other valve closure mechanisms may be used which operate using similar principles, and the depicted equalization valve configuration should not be considered limiting.

In some aspects, the equalizing line 28 includes a first section A, and a second section B. The first section A is configured to transport fluid, from a first region of the safety valve 10 to a second region of the safety valve 10. The fluid in the first region generally has a greater fluid pressure than fluid in the second region of the safety valve 10. In some aspects, as described below, the first region is positioned below the safety valve closure mechanism 226, and the second region is positioned above the safety valve closure mechanism 226. In the open position, the equalization valve closure mechanism 50 allows fluid flow therethrough between the first and second regions to equalize pressure above and below the safety valve closure mechanism 226.

In operation, when fluid pressure in the control line 30 is low, the equalization poppet 50 is biased to a closed position where force of the spring acts on the poppet 50 to push it against the seat and close off a path of fluid communication between a first section A, and a second section B, of the equalizing line 28. Closing off the fluid communication between the first and second sections A and B cuts off communication between fluid above and below the safety valve closure mechanism 226, thereby maintaining the pressure differential between the fluid above and below the safety valve closure mechanism 226.

As illustrated in FIG. 3, the equalization valve 100 further includes an equalization actuator 60, which is reciprocably mounted in the body of the equalization valve 100. In some aspects, the piston actuator 60 is a piston assembly 60, but the configuration of the actuator 60 is not limited thereto. For example, the piston assembly 60 can be any actuator capable of producing a corresponding motion in the equalization valve closure mechanism 50, from the closed position to an open position. In some aspects, piston assembly 60 includes piston head 62 that mates with and otherwise biases an up stop defined within the piston bore when piston assembly urged due to pressurized fluid in the control line 30. The up stop may be a radial shoulder defined by the body of the equalization valve 100 within piston bore, which has a reduced diameter and an axial surface configured to engage a corresponding axial surface of piston head 62. The up stop may generate a mechanical metal-to-metal seal between the piston head and body to prevent the migration of fluids (e.g., hydraulic fluids, production fluids, and the like) therethrough. Other configurations of an up stop that are configured to arrest axial movement of piston assembly 60 are also possible.

In other aspects, a down stop may be arranged within the bore in order to limit the range of axial motion of piston assembly 210. A metal-to-metal seal may be created between piston assembly 60 and the down stop such that the migration of fluids (e.g., hydraulic fluids, production fluids, and the like) therethrough is generally prevented.

Piston assembly 60 is fluidly coupled to the control line 30 to be displaced by a pressurized fluid flowing therein. When the control line 30 pressure is high, i.e., the high-pressure fluid flowing therein pushes against the piston assembly 60 to move it axially towards the poppet 50. A rod of the piston assembly 60 exerts a force on the poppet 50 thereby lifting the poppet 50 off the seat to an open position and opening the path of fluid communication between sections A and B of the equalizing line 28. When sections A and B of the equalizing line 28 are in fluid communication, the upper portion 14 and the lower portion 16 of the safety valve 10 are in fluid communication through the equalizing line 28, and equalization occurs. In some aspects of the disclosure, the piston 62 of the piston assembly may have a diameter larger than the diameter of the lumen 228 of the safety valve 10 in which the safety valve closure mechanism (e.g., flapper) 226 is mounted, depending on the specific application.

During equalization, fluid flows from the high-pressure zone (below flapper 226) in the lower portion 16 to the lower pressure zone (above flapper 226) in the upper portion 14 until fluid pressure above and below the flapper 226 is equal. When the fluid pressure above and below the flapper 226 is equal, then pressure of the fluid required to overcome the pressure below the flapper 226 is reduced as opposed to what it would have been before equalization. Once equalization is complete, a pressurized fluid having the reduced pressure is applied through the control line 30 to overcome the pressure below the flapper 226 and move the flapper to the open position as discussed above with respect to FIG. 2.

Essentially, upon hydraulic pressurization and downward movement of a piston rod 216 of piston assembly 210, flow tube 220 is also displaced downward, eventually overcoming the force associated with torsion spring 230 and any associated downhole fluid pressures. At this point, flapper 226 moves from its closed position to an open position (shown in phantom in FIG. 2). When the hydraulic pressure in the control line 30 is released, the piston and piston rod of piston assembly 60 retract away from the poppet 50, causing the poppet 50 to be biased by the poppet spring back to the closed position on the seat. Furthermore, since the pressure in the control line is released, piston assembly 210 retracts upward, and flow tube 220 is correspondingly displaced upwardly causing the spring force of torsion spring 230 to move flapper 226 back to its closed position, the pressure below the flapper 226 being higher than that above the flapper 226.

Figure 4:
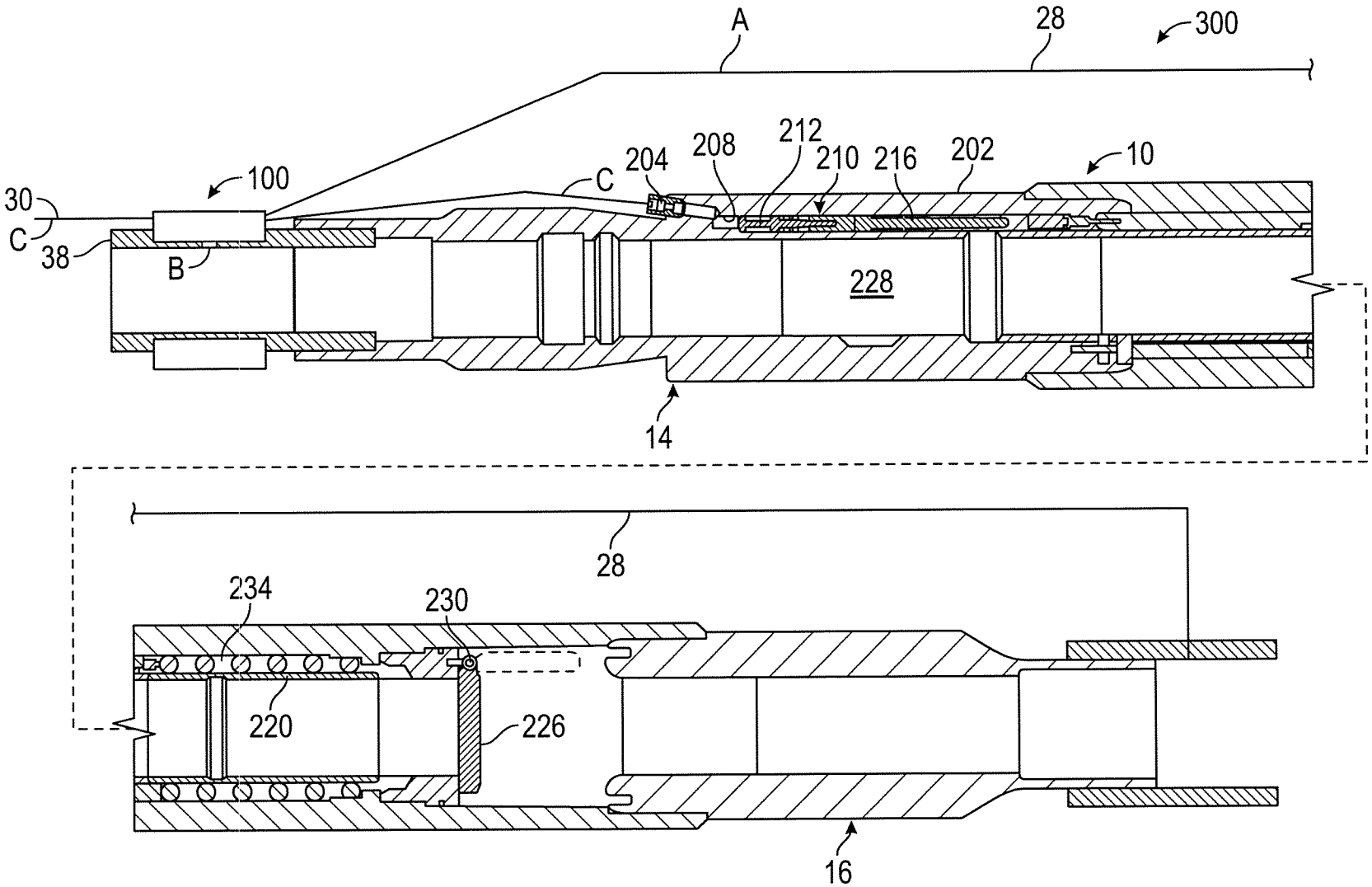
FIG. 4 shows a detailed schematic of another exemplary system for controlling fluid flow in a subterranean well.

FIG. 4 shows a detailed schematic of another exemplary system for controlling fluid flow in a subterranean well. System 300 includes the same elements described with respect to FIG. 2, a description of which is therefore omitted. As illustrated in FIG. 4, system 300 further includes additional, e.g., piping 38, which is coupled to an end section of the upper portion 14 of the body 202 of the safety valve 10. In some aspects, additional piping 38 may be coupled to the upper portion 14 using one or more bonding techniques, such as metal-to-composite bonding techniques (e.g., resin transfer molded processes), temperature cure processing, UV cure processing, combinations thereof, and the like. In yet other aspects, piping 38 may be coupled to the upper portion 14 using one or more adhesives such as, but not limited to, epoxies, acrylics, and urethanes. In other aspects, the piping 38 may be coupled to the upper portion 14 using mechanical and/or hydraulic pressure bonding techniques, as known in the art.

In some aspects of the disclosure, the equalization valve 100 is integral to the safety valve 10 or piping 38. For example, pipe 38 can have multi-layered configurations where it serves as housing for the equalization valve 100.

Figure 5:
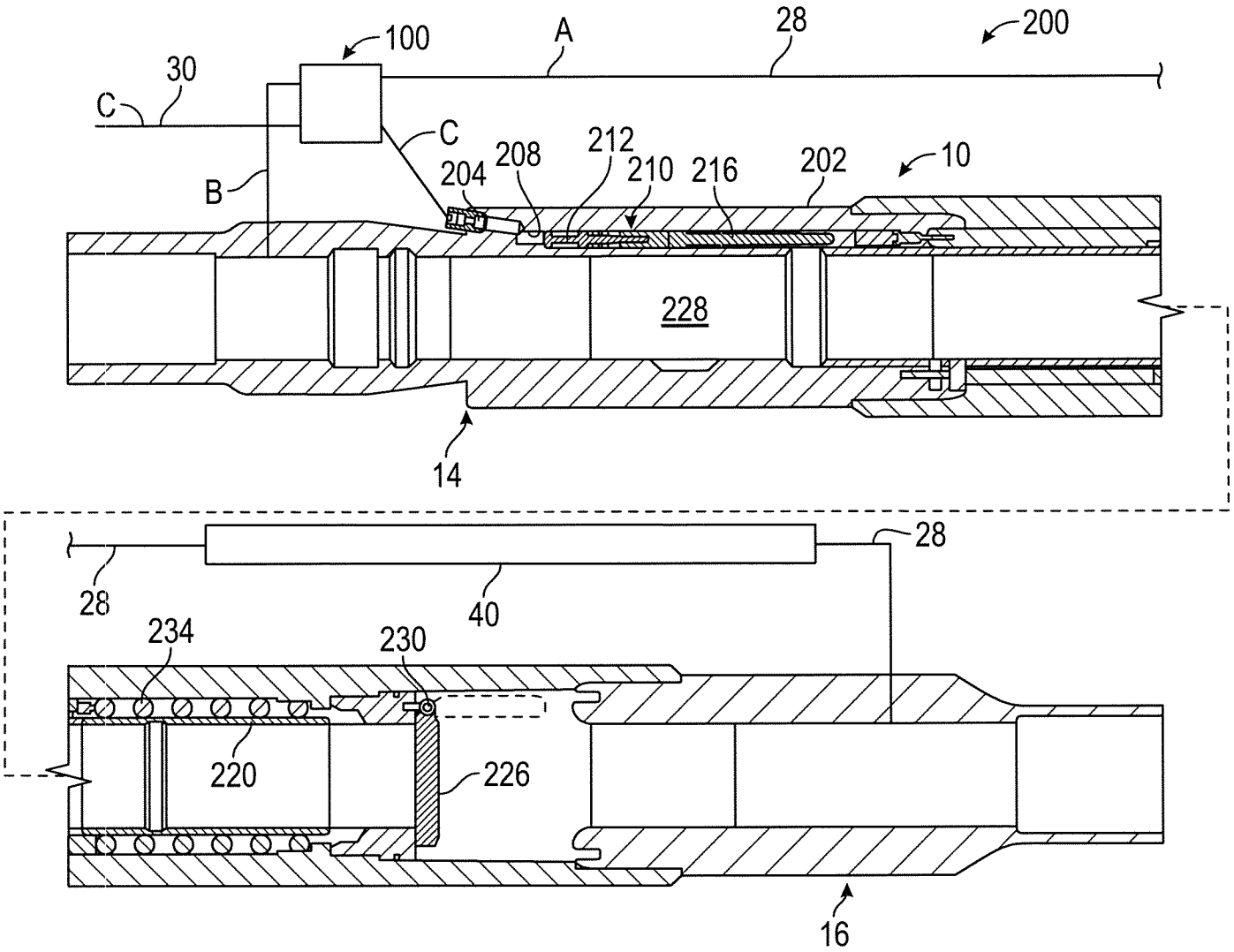
FIG. 5 illustrates a detailed schematic of the exemplary system for controlling fluid flow in a subterranean well of FIG. 2, including a filter.

FIG. 5 illustrates a detailed schematic of the exemplary system for controlling fluid flow in a subterranean well of FIG. 2, including a filter. As illustrated in FIG. 5, a filter 40 is mounted in the equalizing line 28 between the equalization valve 100 and the lower portion 15 of the safety valve 10. Due to the fact that the high velocity pressurized fluid lowing in the line 28 carries debris in it in the form of small chunks of dirt or pieces of stone, the filter 40 is necessary to remove dirt in the fluid stream before it reaches the equalization valve 100 and erodes the internal components thereof. In this sense, the filter 40 can contribute to prolonging of the life of the equalization valve 100 by preventing the internal parts thereof from damage (e.g., flow cutting of the equalization seat). High velocity fluids have nearly zero erosion potential when they are essentially free of debris particles.

The various aspects described herein in which the equalization valve 100 is mounted externally to and separate from the safety valve 10 provide several advantages over conventional equalization devices, which are traditionally mounted within the safety valve. For example, the equalization valve 100 and corresponding components are not limited in size by the size of the safety valve 10, and more particularly not limited to the cross-sectional size of the safety valve closure mechanism 226 (e.g. width of the flapper, where the equalization valve 100 is positioned within the flapper 226) as with conventional equalization devices, which are disposed in the safety valve. Instead, the equalization valve 100 described herein is disposed in fluid communication with an equalizing line which is mounted exterior to the safety valve 10. Thus, the size of the equalization piston assembly 60 and the equalization poppet 50 may be increased or decreased as necessary to fit the desired application and to be able to open up in excess of possible pressure trapped below the flapper 226. The larger the surface area of the equalization valve and its components, e.g., the piston assembly 60, which are exposed to the pressurized hydraulic fluid from the control line 30, the greater a force of the pressurized hydraulic fluid acting on the piston assembly 60, and the quicker equalization occurs. The aforementioned configuration thus provides for quicker equalization, as compared to a configuration where the equalization device is limited to the size of the safety valve and the safety valve closure mechanism. Furthermore, because the size of the equalization device is not limited by that of the safety valve, limits on pressure differentials that could be equalized due to size constraints are removed. As stated above, components of the equalization device can be enlarged as necessary for equalization of higher pressure differentials without causing excessive pressuring in the control line 30, leading to bursting of the control line 30.

Additionally, due to the fact that components of the equalization valve (e.g., the seat on which the poppet sits in the closed position) are not limited by the size of the safety valve, the size of the poppet and corresponding seat can also be increased to fit a desired application. Thus, flow cutting, i.e., damage to the seat due to high velocity pressurized fluid containing debris, of the equalization valve seat is drastically reduced or eliminated due to the increased size or surface area of the equalization poppet and seat.

Furthermore, the various aspects described herein provide an equalization valve 100, which can be added to an existing safety valve configuration without modification since it is mounted externally to and separate from the safety valve. The aforementioned configuration is possible because operation of the equalization valve 100 is independent of motion of the flow tube 220. The flow tube 220 is configured to displace the safety valve closure mechanism to the open position after equalization has occurred. Thus, the equalization valve 100 of the present disclosure varies from the conventional equalization valves or mechanisms in that the equalization valve 100 does not depend on actuation by motion of the flow tube 220 for operation.

A further advantage of the various aspects described herein with respect to the equalization valve lies in that since the equalization valve 100 is not disposed in the safety valve the safety valve can be qualified independently of the equalization valve, thus minimally impacting well drilling operations.

In accordance with some aspects, the system 200 for controlling fluid flow in a subterranean well may include multiple equalization valves 100 disposed in parallel to each other for equalizing pressure across the safety valve closure mechanism. The aforementioned configuration provides the advantage of equalization being performed in a fraction of the time in proportion to the number of equalization valves 100 provided. For example positioning two equalization valves 100 parallel to each other in the system would result in the time taken for equalization to occur to be cut in half.

If three equalization valves 100 are used, the time will be reduced to a third, and so forth. As described above, quicker equalization time leads to less eroding of components of the equalization valves 100, thereby increasing life of the equalization valve(s) 100.

Various aspects of the disclosure are directed to providing a method for controlling fluid flow through the safety valve 10 in the subterranean well 7. In some aspects, the method includes equalizing a fluid pressure above and below the closure mechanism (e.g., flapper 226) of the safety valve 10, and actuating a flow tube 220 of the safety valve 10, after the equalizing, to contact the closure mechanism 226 of the safety valve 10 and displace the closure mechanism of the safety valve 10 from a closed position to an open position (illustrated in FIG. 2).

The equalizing includes providing a control line 30 of a safety valve system 200, including the safety valve 10, with a pressurized hydraulic fluid at a predetermined pressure. The predetermined pressure depends on the application and can vary depending on the cross-section of the safety valve closure mechanism 226. In some aspects, the equalizing further includes fluidly coupling the equalizing line 28 having at least one equalization valve 100 disposed therein with the control line 30 and with the safety valve 10 at positions above and below the closure mechanism 226 of the safety valve 10. Additionally, the equalizing includes applying the pressurized fluid to actuate the piston assembly 60 of the equalization valve 100. The piston assembly 100 pushes the valve closure mechanism 226 of the equalization valve 100 off seat and allows the pressurized fluid to flow from a high pressure region to a low pressure region until the pressure above and below the closure mechanism 226 of the safety valve 10 is equal. The low pressure region and the high pressure region are defined relative to each other, with the high pressure region in some aspects being the region below the safety valve closure mechanism 226, and the low pressure region being the region above the safety valve closure mechanism 226.

In some aspects, the actuating of the flow tube includes, after determining that the equalization has occurred, applying a pressurized fluid through the control line 30 to actuate the piston assembly 60 of the safety valve 10. In this aspect, the piston assembly 60 of the safety valve pushes against and displaces the flow tube 220 in a direction of the safety valve closure mechanism to open the safety valve closure mechanism 226.

Illustration of Subject Technology as Clauses

Various examples of aspects of the disclosure are described as numbered clauses (1, 2, 3, etc. . . . ) for convenience. These are provided as examples and do not limit the subject technology. Identification of the figures and reference numbers are provided below merely as examples for illustrative purposes, and the clauses are not limited by those identifications.

Clause 1: A system for controlling fluid flow in a subterranean well, the system comprising: a first valve comprising a body defining a lumen extending therethrough, the body comprising an upper portion and a lower portion, and a valve closure mechanism disposed therebetween; and a control line fluidly coupled to the first valve to control actuation of the first valve; an equalizing line disposed externally to and separate from the first valve, the equalizing line in fluid communication with the lumen between the upper portion and the lower portion of the body; and at least a second valve in fluid communication with the equalizing line and the control line to equalize a pressure between the upper and lower portions of the body.

Clause 2: The system of Clause 1, wherein the first valve comprises a safety valve, and the second valve comprises an equalization valve.

Clause 3: The system of system of Clause 2, wherein the equalization valve comprises an equalization valve closure mechanism disposed within the equalization valve, the equalization valve closure mechanism being biased to a closed position, and, an equalization actuator fluidly coupled to the control line, and reciprocably disposed within the equalization valve to be displaced towards the equalization valve closure mechanism by a pressurized fluid received from the control line, the equalization actuator configured to actuate and displace the equalization valve closure mechanism from the closed position to an open position, wherein the displacing of the equalization valve closure mechanism to the open position fluidly connects the upper portion and the lower portion to equalize pressure of the fluid below and above the safety valve closure mechanism prior to displacement of the safety valve closure mechanism to the open position.

Clause 4: The system of Clause 3, wherein a size of the equalization valve is larger than a cross-sectional thickness of the safety valve closure mechanism.

Clause 5: The system of Clause 3, wherein the equalization valve closure mechanism comprises a first elastic body to bias the equalization valve to the closed position.

Clause 6: The system of Clause 3, wherein the equalizing line comprises a first section and a second section; and the first section is configured to transport fluid from a first region of the safety valve to a second region of the safety valve, the fluid in the first region having a greater fluid pressure than the fluid in the second region.

Clause 7: The system of Clause 6, wherein: the first region is positioned below the safety valve closure mechanism, and the second region is positioned above the safety valve closure mechanism, and in the open position the equalization valve closure mechanism allows fluid flow therethrough between the first and second regions to equalize pressure above and below the safety valve closure mechanism.

Clause 8: The system of Clause 3, wherein the at least a second valve comprises multiple equalization valves disposed in parallel to each other for equalizing pressure across the safety valve closure mechanism.

Clause 9: The system of Clause 3, further comprising a filter disposed in the equalizing line between second valve and the upper portion.

Clause 10: The system of Clause 2, further comprising piping coupled to an end section of the upper portion of the body of the safety valve, wherein the equalization valve is housed within an inner diameter of the piping.

Clause 11: The system of Clause 1, wherein: the first valve closure mechanism is moveable between an open position and a closed position to selectively allow and prevent hydraulic fluid from flowing through the body; and the first valve further comprises a flow tube reciprocably disposed in the body to contact and displace the first valve closure mechanism from the closed to the open position.

Clause 12: The system of Clause 11, wherein the first valve further comprises: a second elastic body disposed in the lower portion of the first valve body and configured to apply an opposing force to pressurized hydraulic fluid flowing in the control line to keep the first valve closure mechanism in the closed position, and a first valve actuator configured to translate axially within the first valve to cause a corresponding movement of the first valve closure mechanism to the open position.

Clause 13: A method for controlling fluid flow through a safety valve in a subterranean well, the method comprising: equalizing a fluid pressure above and below a closure mechanism of the safety valve, the equalizing comprising: providing a control line of a safety valve system comprising the safety valve with a pressurized hydraulic fluid at a predetermined pressure; fluidly coupling an equalizing line with the control line and with the safety valve at positions above and below the closure mechanism of the safety valve, the equalizing line having at least one equalization valve in fluid communication therewith; and applying the pressurized fluid to actuate actuator of the equalization valve, the actuator pushing a valve closure mechanism of the equalization valve off seat and allowing the pressurized fluid to flow from a high pressure region to a low pressure region of the safety valve until the fluid pressure above and below the closure mechanism of the safety valve is equal; and actuating a flow tube of the safety valve, after the equalizing, to contact the closure mechanism of the safety valve and displace the closure mechanism of the safety valve from a closed position to an open position.

Clause 14: The method of Clause 13, wherein the actuating the flow tube comprises, after determining that the equalizing has occurred, applying a pressurized fluid through the control line to actuate a piston assembly of the safety valve, the piston assembly of the safety valve pushing against and displacing the flow tube in a direction of the safety valve closure mechanism to open the safety valve closure mechanism.

Clause 15: The method of Clause 13, wherein a size of the equalization valve is larger than a cross-sectional thickness of the safety valve closure mechanism.

Clause 16: The method of Clause 13, further comprising filtering a fluid flowing in the equalizing line to filter out particles in the pressurized fluid flowing therethrough and prevent damage to components of the safety valve.

Clause 17: The method of Clause 13, wherein the equalization valve closure mechanism comprises a first elastic body to bias the equalization valve to the closed position.

Clause 18: The method of Clause 13, wherein the equalizing line comprises a first section and a second section; and the first section is configured to transport fluid from a first region of the safety valve to a second region of the safety valve, the fluid in the first region having a greater fluid pressure than the fluid in the second region.

Clause 19: The method of Clause 18, wherein the first region is positioned below the safety valve closure mechanism, and the second region is positioned above the safety valve closure mechanism, and in the open position the equalization valve closure mechanism allows fluid flow therethrough between the first and second regions to equalize pressure above and below the safety valve closure mechanism.

Clause 20: The method of Clause 13, wherein the at least one equalization valve comprises multiple equalization valves disposed in parallel each other for performing the equalizing.

Further Considerations

A reference to an element in the singular is not intended to mean one and only one unless specifically so stated, but rather one or more. For example, "a" module may refer to one or more modules. An element proceeded by "a," "an," "the," or "said" does not, without further constraints, preclude the existence of additional same elements.

Headings and subheadings, if any, are used for convenience only and do not limit the invention. The word exemplary is used to mean serving as an example or illustration. To the extent that the term include, have, or the like is used, such term is intended to be inclusive in a manner similar to the term comprise as comprise is interpreted when employed as a transitional word in a claim. Relational terms such as first and second and the like may be used to distinguish one entity or action from another without necessarily requiring or implying any actual such relationship or order between such entities or actions.

Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

A phrase "at least one of" preceding a series of items, with the terms "and" or "or" to separate any of the items, modifies the list as a whole, rather than each member of the list. The phrase "at least one of" does not require selection of at least one item; rather, the phrase allows a meaning that includes at least one of any one of the items, and/or at least one of any combination of the items, and/or at least one of each of the items. By way of example, each of the phrases "at least one of A, B, and C" or "at least one of A, B, or C" refers to only A, only B, or only C; any combination of A, B, and C; and/or at least one of each of A, B, and C.

It is understood that the specific order or hierarchy of steps, operations, or processes disclosed is an illustration of exemplary approaches. Unless explicitly stated otherwise, it is understood that the specific order or hierarchy of steps, operations, or processes may be performed in different order. Some of the steps, operations, or processes may be performed simultaneously. The accompanying method claims, if any, present elements of the various steps, operations or processes in a sample order, and are not meant to be limited to the specific order or hierarchy presented. These may be performed in serial, linearly, in parallel or in different order. It should be understood that the described instructions, operations, and systems can generally be integrated together in a single software/hardware product or packaged into multiple software/hardware products.

In one aspect, a term coupled or the like may refer to being directly coupled. In another aspect, a term coupled or the like may refer to being indirectly coupled.

Terms such as top, bottom, front, rear, side, horizontal, vertical, and the like refer to an arbitrary frame of reference, rather than to the ordinary gravitational frame of reference. Thus, such a term may extend upwardly, downwardly, diagonally, or horizontally in a gravitational frame of reference.

The disclosure is provided to enable any person skilled in the art to practice the various aspects described herein. In some instances, well-known structures and components are shown in block diagram form in order to avoid obscuring the concepts of the subject technology. The disclosure provides various examples of the subject technology, and the subject technology is not limited to these examples. Various modifications to these aspects will be readily apparent to those skilled in the art, and the principles described herein may be applied to other aspects.

All structural and functional equivalents to the elements of the various aspects described throughout the disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for".

The title, background, brief description of the drawings, abstract, and drawings are hereby incorporated into the disclosure and are provided as illustrative examples of the disclosure, not as restrictive descriptions. It is submitted with the understanding that they will not be used to limit the scope or meaning of the claims. In addition, in the detailed description, it can be seen that the description provides illustrative examples and the various features are grouped together in various implementations for the purpose of streamlining the disclosure. The method of disclosure is not to be interpreted as reflecting an intention that the claimed subject matter requires more features than are expressly recited in each claim. Rather, as the claims reflect, inventive subject matter lies in less than all features of a single disclosed configuration or operation. The claims are hereby incorporated into the detailed description, with each claim standing on its own as a separately claimed subject matter.

The claims are not intended to be limited to the aspects described herein, but are to be accorded the full scope consistent with the language claims and to encompass all legal equivalents. Notwithstanding, none of the claims are intended to embrace subject matter that fails to satisfy the requirements of the applicable patent law, nor should they be interpreted in such a way.

One or more illustrative aspects incorporating the features of the present disclosure are presented herein. Not all features of a physical implementation are necessarily described or shown in this application for the sake of clarity. It is to be understood that in the development of a physical implementation incorporating the aspects of the present disclosure, numerous implementation-specific decisions may be made to achieve the developer's goals, such as compliance with system-related, business-related, government-related and other constraints, which may vary by implementation and from time to time. While a developer's efforts might be time-consuming, such efforts would be, nevertheless, a routine undertaking for one having ordinary skill in the art and the benefit of this disclosure.

In the description herein, directional terms such as "above", "below", "upper", "lower", and the like, are used for convenience in referring to the accompanying drawings. In general, "above", "upper", "upward" and similar terms refer to a direction toward the exit of a wellbore, often toward the earth's surface, and "below", "lower", "downward" and similar terms refer to a direction away from the exit of a wellbore, often away from the earth's surface.

Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the specification and attached claims are approximations that may vary depending upon the desired properties sought to be obtained by the aspects of the present disclosure. At the very least, and not as an attempt to limit the application of the doctrine of equivalents to the scope of the claim, each numerical parameter should at least be construed in light of the number of reported significant digits and by applying ordinary rounding techniques.

Therefore, the present disclosure is well adapted to attain the ends and advantages mentioned as well as those that are inherent therein. The particular aspects disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative aspects disclosed above may be altered, combined, or modified and all such variations are considered within the scope and spirit of the present disclosure. The disclosure illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces.

What is claimed is:

1. A system for controlling fluid flow in a subterranean well, the system comprising:

a first valve comprising a body defining a lumen extending therethrough, the body comprising an upper portion and a lower portion, and a valve closure mechanism disposed therebetween; and a control line;

an equalizing line disposed externally to and separate from the first valve, the equalizing line in fluid communication with the lumen between the upper portion and the lower portion of the body; and at least a second valve in fluid communication with the equalizing line and the control line to equalize a pressure of fluid between the upper and lower portions of the body, wherein the control line is fluidly coupled to the second valve to control actuation of the first valve.

2. The system of claim 1, wherein the first valve comprises a safety valve, and the second valve comprises an equalization valve.

3. The system of claim 2, wherein the equalization valve comprises:

an equalization valve closure mechanism disposed within the equalization valve, the equalization valve closure mechanism being biased to a closed position; and an equalization actuator fluidly coupled to the control line, and reciprocably disposed within the equalization valve to be displaced towards the equalization valve closure mechanism by a pressurized fluid received from the control line, the equalization actuator configured to actuate and displace the equalization valve closure mechanism from the closed position to an open position, wherein the displacing of the equalization valve closure mechanism to the open position fluidly connects the upper portion and the lower portion to equalize the pressure of the fluid below and above the safety valve closure mechanism prior to displacement of the safety valve closure mechanism to the open position.

4. The system of claim 3, wherein a size of the equalization valve is larger than a cross-sectional thickness of the safety valve closure mechanism.

5. The system of claim 3, wherein the equalization valve closure mechanism comprises a first elastic body to bias the equalization valve to the closed position.

6. The system of claim 3, wherein:

the equalizing line comprises a first section and a second section; and the first section is configured to transport fluid from a first region of the safety valve to a second region of the safety valve, the fluid in the first region having a greater fluid pressure than the fluid in the second region.

7. The system of claim 6, wherein:

the first region is positioned below the safety valve closure mechanism, and the second region is positioned above the safety valve closure mechanism; and in the open position, the equalization valve closure mechanism allows fluid flow therethrough between the first and second regions to equalize pressure above and below the safety valve closure mechanism.

8. The system of claim 3, wherein the at least a second valve comprises multiple equalization valves disposed in parallel to each other for equalizing pressure across the safety valve closure mechanism.

9. The system of claim 3, further comprising a filter disposed in the equalizing line between second valve and the upper portion.

10. The system of claim 2, further comprising piping coupled to an end section of the upper portion of the body of the safety valve, wherein the equalization valve is housed within an inner diameter of the piping.

11. The system of claim 1, wherein:

the first valve closure mechanism is moveable between an open position and a closed position to selectively allow and prevent hydraulic fluid from flowing through the body; and the first valve further comprises a flow tube reciprocably disposed in the body to contact and displace the first valve closure mechanism from the closed to the open position.

12. The system of claim 11, wherein the first valve further comprises:

a second elastic body disposed in the lower portion of the first valve body and configured to apply an opposing force to pressurized hydraulic fluid flowing in the control line to keep the first valve closure mechanism in the closed position; and a first valve actuator configured to translate axially within the first valve to cause a corresponding movement of the first valve closure mechanism to the open position.

13. A method for controlling fluid flow through a safety valve in a subterranean well, the method comprising:

equalizing a fluid pressure above and below a closure mechanism of the safety valve, the equalizing comprising:

providing a control line of a safety valve system comprising the safety valve with a pressurized hydraulic fluid at a predetermined pressure;

fluidly coupling an equalizing line with the safety valve at positions above and below the closure mechanism of the safety valve, the equalizing line having at least one equalization valve in fluid communication therewith;

fluidly coupling the control line with the equalization valve; and applying the pressurized fluid to actuate an actuator of the equalization valve, the actuator pushing a valve closure mechanism of the equalization valve off seat and allowing the pressurized fluid to flow from a high pressure region to a low pressure region of the safety valve until the fluid pressure above and below the closure mechanism of the safety valve is equal; and actuating a flow tube of the safety valve, after the equalizing, to contact the closure mechanism of the safety valve and displace the closure mechanism of the safety valve from a closed position to an open position.

14. The method of claim 13, wherein the actuating the flow tube comprises, after determining that the equalizing has occurred, applying a pressurized fluid through the control line to actuate a piston assembly of the safety valve, the piston assembly of the safety valve pushing against and displacing the flow tube in a direction of the safety valve closure mechanism to open the safety valve closure mechanism.

15. The method of claim 13, wherein a size of the equalization valve is larger than a cross-sectional thickness of the safety valve closure mechanism.

16. The method of claim 13, further comprising filtering a fluid flowing in the equalizing line to filter out particles in the pressurized fluid flowing therethrough and prevent damage to components of the safety valve.

17. The method of claim 13, wherein the equalization valve closure mechanism comprises a first elastic body to bias the equalization valve to the closed position.

18. The method of claim 13, wherein:

the equalizing line comprises a first section and a second section; and the first section is configured to transport fluid from a first region of the safety valve to a second region of the safety valve, the fluid in the first region having a greater fluid pressure than the fluid in the second region.

19. The method of claim 18, wherein:

the first region is positioned below the safety valve closure mechanism, and the second region is positioned above the safety valve closure mechanism; and in the open position, the equalization valve closure mechanism allows fluid flow therethrough between the first and second regions to equalize pressure above and below the safety valve closure mechanism.

20. The method of claim 13, wherein the at least one equalization valve comprises multiple equalization valves disposed in parallel each other for performing the equalizing.

* * * * *